US010563353B2

(12) United States Patent
Collins et al.

(10) Patent No.: US 10,563,353 B2
(45) Date of Patent: Feb. 18, 2020

(54) PAPERMAKING FABRIC INCLUDING TEXTURED CONTACTING SURFACE

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 44 days.

(21) Appl. No.: 16/060,391

(22) PCT Filed: Dec. 19, 2017

(86) PCT No.: PCT/US2017/067176
§ 371 (c)(1),
(2) Date: Jun. 7, 2018

(87) PCT Pub. No.: WO2018/125653
PCT Pub. Date: Jul. 5, 2018

(65) Prior Publication Data

US 2019/0360152 A1 Nov. 28, 2019

Related U.S. Application Data

(60) Provisional application No. 62/440,585, filed on Dec. 30, 2016.

(51) Int. Cl.
*D21F 1/00* (2006.01)
*D21F 1/10* (2006.01)
(Continued)

(52) U.S. Cl.
CPC ..... *D21F 1/0027* (2013.01); *D03D 15/04* (2013.01); *D21F 7/12* (2013.01); *D21F 11/006* (2013.01);
(Continued)

(58) Field of Classification Search
CPC .... D21F 1/0027; D21F 1/0036; D21F 1/0063; D21F 1/105; D21F 7/08; D21F 7/083;
(Continued)

(56) References Cited

U.S. PATENT DOCUMENTS 4,408,638 A 10/1983 Strom
4,423,755 A 1/1984 Thompson
(Continued)

OTHER PUBLICATIONS

Ellis, Catharine, "Woven Shibori," (The Weaver's Studio series), Oct. 1, 2005, pp. 92-100.
(Continued)

*Primary Examiner* — Eric Hug
(74) *Attorney, Agent, or Firm* — Kimberly-Clark Worldwide, Inc.

(57) ABSTRACT

Provided are woven papermaking fabrics useful in the manufacture of tissue products, particularly through-air dried tissue products. The fabrics generally have a plurality of protuberances disposed on the web contacting surfaces. The protuberances are formed from a plurality warp filaments interwoven with a plurality of shute filaments and have a hollow interior pocket, which is generally bounded by the warp and shute filaments. By providing protuberances with hollow interior pockets the air permeability of the resulting woven papermaking fabric may be improved, and in certain instances may be increased, relative to similar fabrics having protuberances that are non-hollow.

11 Claims, 8 Drawing Sheets

(51) Int. Cl.

| | |
|---|---|
| ***D03D 15/04*** | (2006.01) |
| ***D21F 7/12*** | (2006.01) |
| ***D21F 11/00*** | (2006.01) |
| *D21F 2/00* | (2006.01) |
| *D21F 5/18* | (2006.01) |

(52) U.S. Cl.
CPC ..... *D21F 1/10* (2013.01); *D21F 2/00* (2013.01); *D21F 5/18* (2013.01)

(58) Field of Classification Search
CPC ..... D21F 7/12; D21F 2/00; D21F 5/18; D21F 11/006; D21F 11/008; D21F 11/14; D21F 11/145; D03D 13/00; D03D 15/04; D03D 11/00; D03D 11/02; D03D 25/00; D03D 3/04
USPC ..... 162/116, 296, 348, 362, 900, 902–903
See application file for complete search history.

(56) References Cited

U.S. PATENT DOCUMENTS

| | | | | |
|---|---|---|---|---|
| 4,470,434 | A | 9/1984 | Vuorio | |
| 4,642,261 | A | 2/1987 | Fearnhead | |
| 4,759,391 | A | 7/1988 | Waldvogel | |
| 4,849,054 | A | 7/1989 | Klowak | |
| 4,985,084 | A | 1/1991 | Hakkarainen | |
| 4,998,568 | A | 3/1991 | Vohringer | |
| 5,277,967 | A | 1/1994 | Zehle | |
| 5,429,686 | A | 7/1995 | Chiu | |
| 5,449,026 | A | 9/1995 | Lee | |
| 5,672,248 | A | 9/1997 | Wendt | |
| 5,975,149 | A | 11/1999 | Lee | |
| 6,039,838 | A | 3/2000 | Kaufman | |
| 6,237,644 | B1 * | 5/2001 | Hay | D21F 1/0027 139/383 A |
| 6,287,426 | B1 | 9/2001 | Edwards | |
| 6,708,732 | B1 | 3/2004 | Hay | |
| 6,808,599 | B2 | 10/2004 | Burazin | |
| 6,920,902 | B2 | 7/2005 | Majaury | |
| 7,048,012 | B2 | 5/2006 | Martin | |
| 7,059,361 | B1 | 6/2006 | Hansson | |
| 7,300,554 | B2 | 11/2007 | LaFond | |
| 7,445,032 | B2 | 11/2008 | Barrett | |
| 7,476,293 | B2 | 1/2009 | Herman | |
| 7,726,349 | B2 | 6/2010 | Mullally | |
| 7,931,051 | B2 | 4/2011 | Ward | |
| 7,980,275 | B2 | 7/2011 | Gstrein | |
| 8,394,236 | B2 | 3/2013 | Edwards | |
| 2010/0129597 | A1 | 5/2010 | Hansen | |

OTHER PUBLICATIONS

Van Der Hoogt, Madelyn, editor "Fabrics that Go Bump," (The Best of Weaverâ€™ s series), published by Alexis Yiorgos Xenakis, Sep. 1, 2002, pp. 18-24, 84-85, 100-105.

Alderman, Sharon, "Master Weave Structures: Transforming Ideas into Great Cloth," published by Interweave Press, Apr. 1, 2009, pp. 179-185.

* cited by examiner

PAPERMAKING FABRIC INCLUDING TEXTURED CONTACTING SURFACE

BACKGROUND

The present invention relates to the field of paper manufacturing. More particularly, the present invention relates to the manufacture of absorbent tissue products such as bath tissue, facial tissue, napkins, towels, wipers, cardboard, and the like. Specifically, the present invention relates to improved papermaking fabrics used to manufacture absorbent tissue products, methods of tissue manufacture, methods of fabric manufacture, and the actual tissue products produced thereby.

In the manufacture of tissue products, particularly absorbent tissue products, papermaking fibers are deposited onto forming wires and transferred as a newly-formed web to a transfer fabric, often with the aid of a vacuum box. From the transfer fabric, the web is then transferred to a through-air drying fabric to dry the web, which can provide the physical properties and the final product appearance to the web. There is a continuing need to improve web properties and machine operation by improving the transfer fabric. As an example, there is a need to improve the uniformity of the cross-direction (CD) strain in such transfer fabrics. There is also a need to improve through-air drying fabrics for improved operation of the machine as well as improved properties of the web and its visual appearance.

Some woven papermaking fabrics attempt to address some of these opportunities. For example, in traditional woven papermaking fabrics, topography in a transfer papermaking fabric was achieved by juxtaposing areas of tight weave of shute and warp filaments with areas of loose weave of shute and warp filaments that created unbalanced forces in the woven fabric to push long floats out of plane creating tight bundles of warp filaments. While this can provide varied topographies in the woven papermaking fabric, this technique provides some disadvantages, including, but not limited to: poor air permeability through the stacked warp filament bundles, limits on height of the topographical elements created by the warp filament bundles based on the number of warps that could be stacked (alternatively viewed as limits on pocket depth between topographical elements), difficulties in achieving uniformity of fiber support, aesthetic limitations, areas of excessive localized strain, creation of excessive pinholes especially in high cross-directional strain sheet contacting surfaces, and difficulties in weaving designs. Some of these disadvantages due to past woven papermaking fabric techniques can lead to deficiencies in the tissue being carried and produced on the papermaking fabric. For example, warp filament stacking can create areas of low basis weight in the base tissue sheet, decreased drying efficiency, and difficulties in tissue sheet release.

As such, there remains a need for articles of manufacture and methods of producing tissue products with improved physical properties without losses to tissue machine efficiency and productivity.

SUMMARY

The present disclosure comprises paper manufacturing articles and processes that may satisfy one or more of the foregoing needs. For example, a paper manufacturing fabric of the present disclosure, when used as a transfer fabric in a tissue making process, produces an absorbent tissue web having improved paper properties and can result in improved manufacturing. The papermaking fabrics of the present disclosure could alternatively be used as through-air drying fabrics. Accordingly, the present disclosure is directed towards fabrics for manufacturing the absorbent tissue product, processes of making the absorbent tissue product, and processes of making the papermaking fabric.

Accordingly, in one aspect, a papermaking fabric is provided that includes a plurality of filaments, the plurality of filaments being woven together. The papermaking fabric can also include a machine contacting side and a web contacting side. The web contacting side can be opposite from the machine contacting side. The papermaking fabric can include at least one protuberance on the web contacting side of the papermaking fabric. The at least one protuberance can include a hollow internal pocket. The hollow internal pocket can include a height and a width.

In another aspect, a papermaking fabric can include a machine contacting side and a web contacting side. The papermaking fabric can include a first set of filaments including a first shrinkage property. The papermaking fabric can also include a second set of filaments including a second shrinkage property. The first shrinkage property can be different from the second shrinkage property. The first set of filaments and the second set of filaments can be woven and provide at least one protuberance on the web contacting side of the papermaking fabric. The at least one protuberance can define a hollow internal pocket.

In yet another aspect, a method of manufacturing a papermaking fabric comprising the steps of providing a plurality of warp filaments and a plurality of shute filaments for weaving, at least a portion of the plurality of warp filaments having a first shrinkage property and a portion of the plurality of shute filaments having a second shrinkage property, the first shrinkage property being different than the second shrinkage property; weaving the shute filaments and the warp filaments in a weave pattern to provide a woven fabric including a first machine direction end opposite from a second machine direction end and a machine contacting side opposite from a web contacting side; heating the first set of filaments and the second set of filaments after the plurality of shute filaments and the plurality of warp filaments are woven, wherein heating results in at least one protuberance having a hollow internal pocket; and seaming together the first and second machine direction ends of the woven fabric.

DEFINITIONS

Figure 1:
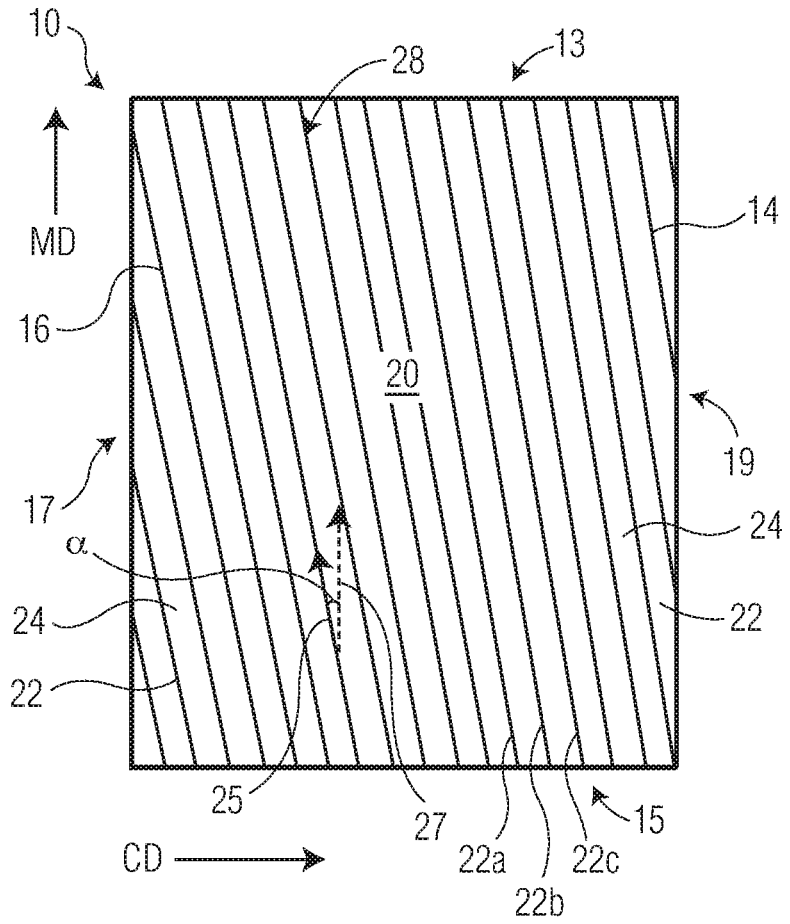
FIG. 1 illustrates a top view of a papermaking fabric showing the two machine direction ends of the papermaking fabric.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulosic web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as a through-air drying fabric as described in U.S. Pat. Nos. 5,429,686, 6,808,599 B2 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warp (s)" generally refers to machine-direction yarns and the term "shute" generally refers to cross-machine direction yarns, although it is known that fabrics can be manufactured in one orientation and run on a paper machine in a different orientation.

As used herein, the term "protuberance" generally refers to a three dimensional element formed by one or more warp filaments overlaying a plurality of weft yarns. In certain embodiments the combination of the longitudinal spacing of the cross-direction floats in the first shute filaments, the first shute filaments having a higher shrinkage property than the second shute filaments, and high friction tying areas between the cross-direction floats allow the first shute filaments to shrink and cause the adjacent second shute filaments to buckle and form the protuberances on the web contacting side of the papermaking fabric after heat finishing.

As used herein the term "hollow," with particular reference to protuberances, means that the protuberances contain an internal cavity or void region.

As used herein, the term "landing area" generally refers to a portion of the web contacting surface of the papermaking fabric lying between adjacent protuberances.

As used herein, the term "landing area plane" is defined by the top of the lowest visible yarn which a tissue web can contact when molding into a papermaking fabric constructed according to the present invention. The landing area plane can be defined by a warp knuckle, a shute knuckle, or by both. The landing area plane is the z-direction plane intersecting the top of the elements forming a landing area disposed on the web contacting surface of the fabric.

As used herein the term "discrete" when referring to a protuberance of a papermaking fabric according to the present invention means that the protuberance is visually unconnected from other protuberances and does not extend continuously in any dimension of the papermaking fabric surface. A protuberance may be discrete despite being formed from a single continuous filament. For example, a single continuous warp filament may be woven such that it forms a plurality of discrete substantially machine direction oriented protuberances where each protuberance has a first proximal end and a first distal end where the ends of the protuberance terminate at spaced apart shute filaments.

As used herein the term "continuous" when referring to a three-dimensional element of a papermaking fabric according to the present invention, such as protuberance or a pattern, means that the element extends throughout one dimension of the papermaking fabric surface. When referring to a protuberance the term refers to a protuberance comprising two or more warp filaments that extend without interruption throughout one dimension of the woven fabric.

As used herein, the term "uninterrupted" generally refers to a protuberance having an upper surface plane that extends without interruptions and remains above the landing area surface plane for length of the protuberance. Undulations of the upper surface plane within a protuberance along its length such as those resulting from twisting of warp filaments or warp filaments forming the protuberance tucking under one another are not considered to be interruptions.

As used herein the term "substantially machine direction oriented" as it refers to a protuberance means that the total length of the protuberance that is positioned at an angle of greater than 45 degrees to the cross-machine direction is greater than the total length of the protuberance that is positioned at an angle of 45 degrees or less to the cross-machine direction.

As used herein the term "pattern" refers to any non-random repeating design, figure, or motif. Generally the fabrics of the present invention may comprise decorative patterns comprising a plurality of line elements, however, it is not necessary that the line elements form recognizable shapes, and a repeating design of the line elements is considered to constitute a decorative pattern.

As used herein the term "twill pattern" generally refers to a pattern of parallel protuberances having an element angle greater than about 0.5 degrees, such as from about 0.5 to about 20 degrees, and protuberances that extend uninterrupted along their entire distance. In a particularly preferred embodiment all of the parallel protuberances forming a twill pattern are equally spaced from one another to provide the pattern with a pitch greater than about 0.5 mm, such as from about 0.5 to about 5.0 mm.

DETAILED DESCRIPTION

The present inventors have now surprisingly discovered that certain papermaking belts having high topography, or textures, disposed thereon may be used to produce tissue webs and products that are both smooth and have high bulk with improved operating efficiency. Accordingly, in certain embodiments the present invention provides an apparatus for manufacturing paper and more preferably tissue webs and products. The apparatus according to the present invention is preferably embodied in a papermaking fabric. In preferred embodiments, the papermaking fabric can be utilized as a transfer fabric. As used herein, "papermaking belt" may be synonymous with "papermaking fabric."

Figure 2:
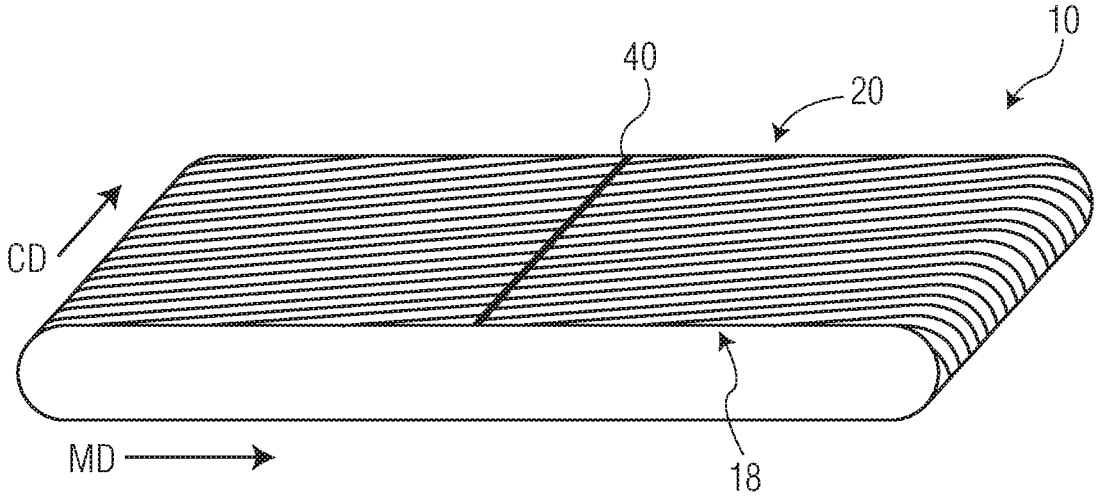
FIG. 2 illustrates the papermaking fabric of FIG. 3 including a seam.

With reference now to FIGS. 1 and 2, one embodiment of a papermaking fabric according to the present invention is illustrated. The fabric 10 has two principal dimensions—a machine direction (MD), which is the direction within the plane of the fabric 10 parallel to the principal direction of travel of the tissue web during manufacture and a cross-machine direction (CD), which is generally orthogonal to the machine direction. The papermaking fabric 10 generally comprises a plurality of filaments that can be woven together. The papermaking fabric can include a first longitudinal end 13 and a second longitudinal end 15 that can be joined to form a seam 40 as shown in FIG. 2. As will be described in further detail below, the filaments can include a plurality of warp filaments 14 and a plurality of shute filaments 16 that can be woven together to form a machine contacting side 18 and a web contacting side 20 of the woven papermaking fabric 10. The web contacting side 20 can be opposite from the machine contacting side 18. Machinery employed in a typical papermaking operation is well known in the art and may include, for example, vacuum pickup shoes, rollers, and drying cylinders. In a preferred embodiment, the papermaking fabric 10 comprises a through-air drying fabric useful for transporting an embryonic tissue web across drying cylinders during the tissue manufacturing process. However, in other embodiments, the woven papermaking fabric 10 can comprise a transfer fabric for transporting an embryonic tissue web from forming wires to a through-air drying fabric. In these embodiments, the web contacting side 20 supports the embryonic tissue web, while the opposite surface, the machine contacting side 18, contacts the surrounding machinery.

The web contacting side 20 of the fabric 10 comprises a plurality of protuberances 22. The protuberances 22 are generally disposed on the web-contacting surface 20 for cooperating with, and structuring of, the wet fibrous web during manufacturing. In a particularly preferred embodiment the web contacting surface 20 comprises a plurality of spaced apart three dimensional protuberances 22 distributed across the web-contacting surface 20 of the fabric 10 and together constituting from at least about 15 percent of the web-contacting surface, such as from about 15 to about 35 percent, more preferably from about 18 to about 30 percent, and still more preferably from about 20 to about 25 percent of the web-contacting surface.

The protuberances 22, such as those illustrated in FIG. 1, may extend generally in a first direction along a major axis 25 across one dimension of the fabric 10 in a continuous fashion. In this manner a protuberance 22 may extend from a first lateral edge 17 of the fabric 10 to a second lateral edge 19. In such embodiments the length of the protuberance is dependent upon the length of the fabric 10 and the angle of the protuberance relative to the machine direction (MD). For example, the protuberances 22*a*-22*c* may arranged in a parallel fashion and extend along a major axis 25 at an angle ($\alpha$) relative to the machine direction axis 27. In this manner the protuberances 22 generally have a long direction axis, i.e., the major axis 25, that intersects the machine direction axis 27 to form an element angle ($\alpha$), which is preferably greater than about 0.5 degrees, and more preferably greater than about 2.0 degrees and still more preferably greater than about 5.0 degrees, such as from about 0.5 to about 20 degrees and more preferably from about 2.0 to about 15.0 degrees and still more preferably from about 5.0 to about 10.0 degrees. While the illustrated protuberances are arranged in a parallel fashion and have the same element angle, the invention is not so limited. In other embodiments the element angle may vary amongst the protuberances.

Generally the protuberances are spaced apart from one another so as to define landing areas there-between. In certain instances, such as when the instant papermaking fabrics are used as a through-air drying fabric, the fibers of the embryonic tissue web are deflected in the z-direction by the protuberances, which bound landing areas, and are disposed along the landing area plane to yield a web having a three-dimensional topography. The spacing of protuberances can be provided such that the tissue web conforms to the protuberances and is deposited in the landing area without tearing.

With continued reference to FIG. 1, the web-contacting surface 20 may comprises a plurality of land areas 24, which are generally bounded by adjacent protuberances 22*a*, 22*b* and coextensive with the upper surface plane of the fabric 10. In the illustrated embodiment the land areas 24, like the protuberances 22, are continuous and extend across the plane of the fabric diagonally from a first lateral edge 17 to a second fabric edge 19. The land areas 24 are generally permeable to liquids and allow water to be removed from the cellulosic tissue web by the application of differential fluid pressure, by evaporative mechanisms, or both when drying air passes through the embryonic tissue web while on the papermaking fabric 10 or a vacuum is applied through the fabric 10. Without being bound by any particularly theory, it is believed that the arrangement of protuberances and landing areas allow the molding of the embryonic web causing fibers to deflect in the z-direction and generate the caliper of, and patterns on the resulting tissue web.

Figure 3:
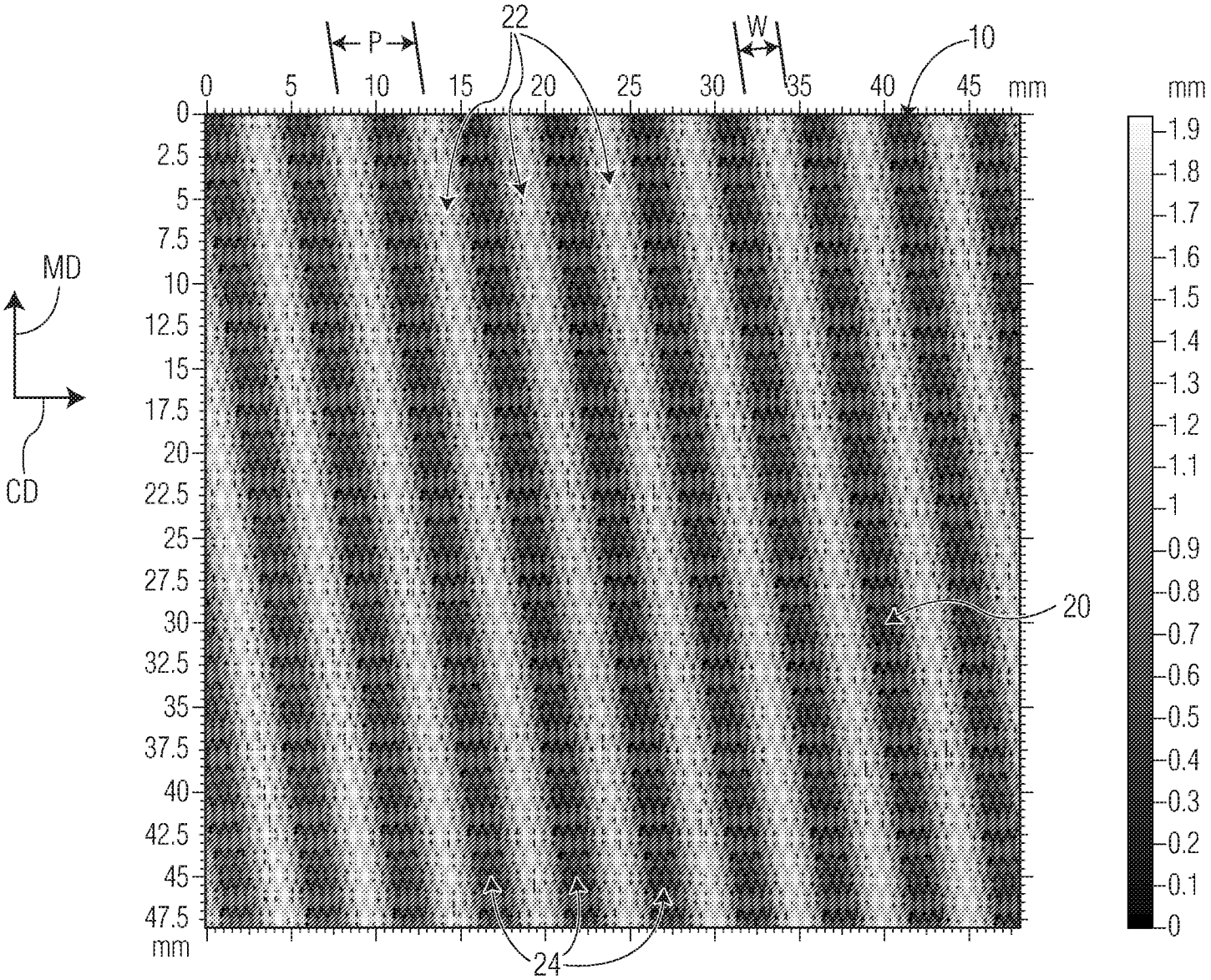
FIG. 3 is a profilometry scan of the web contacting surface of an exemplary papermaking fabric according to one embodiment of the present disclosure.

With reference now to FIG. 3, the web contacting side 20 of the papermaking fabric 10 preferably comprises at least one protuberance 22 that cooperates with and structures the wet fibrous web during manufacturing. In preferred embodiments, such as the embodiment illustrated in FIG. 3, the web contacting side 20 of the papermaking fabric 10 can include a plurality of protuberances 22 (only three protuberances 22 labeled in FIG. 3 for purposes of clarity). The protuberances 22 can be discrete, semi-continuous or continuous. In the embodiment illustrated in FIG. 1, the protuberances 22 are of the same design, however, it is contemplated that a papermaking fabric 10 can include a plurality of protuberances 22 that include two or more designs.

As will be discussed in more detail below, it is generally preferred that at least a portion of the protuberances are permeable to liquids and allow water to be removed from the cellulosic fibrous structure by the application of differential fluid pressure, by evaporative mechanisms, or both when drying air passes through the embryonic tissue web while on the papermaking fabric or a vacuum is applied through the papermaking fabric. Accordingly, it is generally preferred that at least a portion of the protuberances be hollow.

With continued reference to FIG. 3, the web contacting side 20 can also include at least one landing area 24. In some embodiments, the web contacting side 20 can include a plurality of land areas 24 (only three land areas 24 being labeled in FIG. 3 for purposes of clarity). The landing area(s) 24 can surround the protuberances 22, or can be bound by the protuberances 22. Land areas 24 are generally permeable to liquids and allow water to be removed from the cellulosic fibrous structure by the application of differential fluid pressure, by evaporative mechanisms, or both when drying air passes through the embryonic tissue web while on the papermaking fabric or a vacuum is applied through the papermaking fabric.

The plurality of protuberances and landing areas provide a textured surface for contacting the web. In some embodiments, the plurality of protuberances and landing areas can provide a decorative pattern on the papermaking fabric. For example, it is contemplated that a protuberance could be linear, arcuate, or sinusoidal in shape, or any other suitable shape. The protuberances can form shapes such as rectangles, squares, circles, ovals, etc. The protuberances can form an array of rows and/or columns, and in some embodiments, can be evenly spaced in either or both the machine direction and the cross-machine direction. In the embodiment illustrated in FIG. 3, the protuberances 22 are semi-continuous and extend in a machine direction at a slight angle with respect to the machine direction, referred to as a twill pattern.

Figure 4:
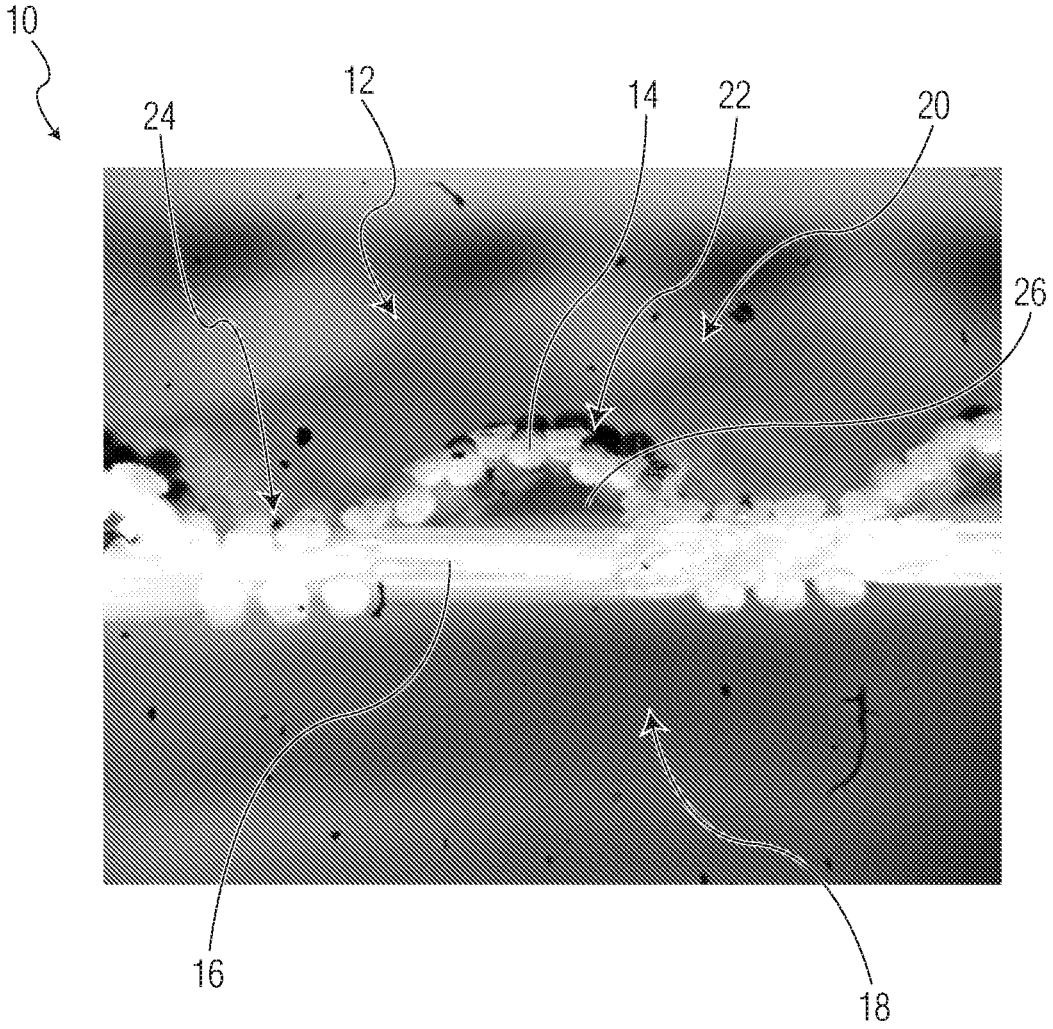
FIG. 4 is a cross-sectional view of a segment of the papermaking fabric of FIG. 3.
Figure 5:
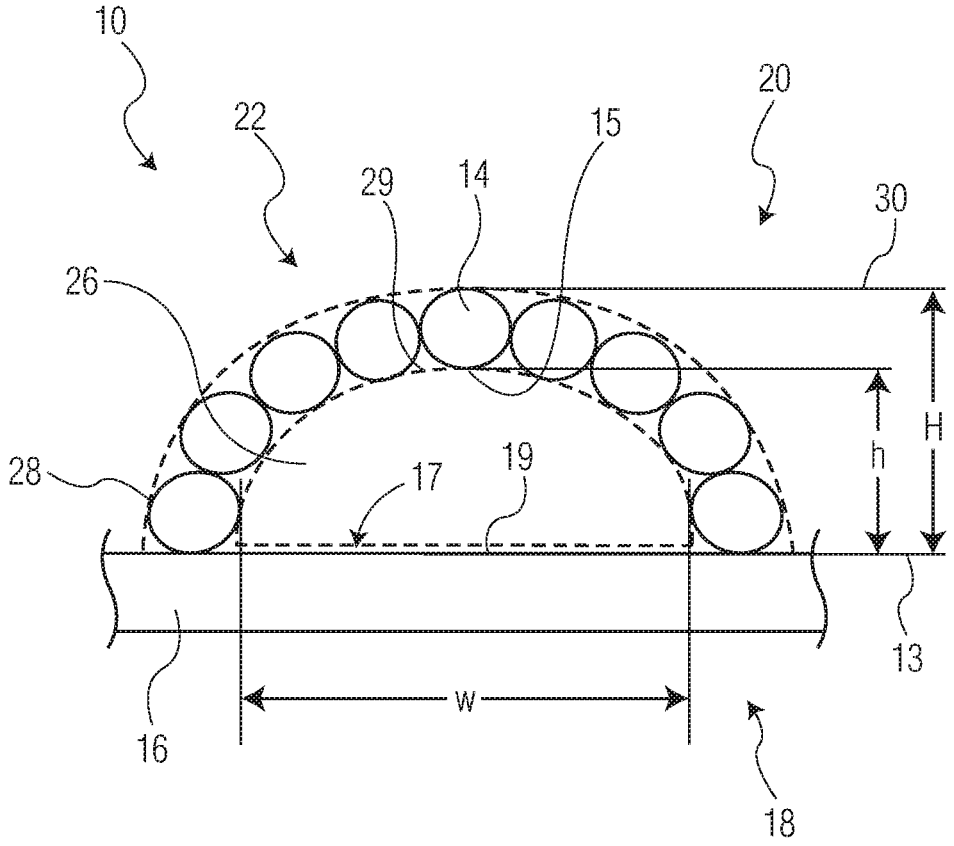
FIG. 5 illustrates a cross-sectional view of an exemplary papermaking fabric according to one embodiment of the present disclosure.

Generally at least one protuberance 22 is hollow and includes an internal pocket 26 (delineated by dashed line 29 in FIG. 5). Referring to FIGS. 4 and 5, it can be seen that when the protuberances 22 are hollow, they tend have an outer shell 28 formed from a plurality of woven warp filaments 14. The inner surface of the plurality of warp filaments 14, together with a plurality of shute filaments 16, defines an interior pocket 26 (delineated by dashed line 29 in FIG. 5) which is generally devoid of warp filaments. In some instances, there may not be a well-defined demarcation between the warp filaments forming the outer shell 28 and the hollow internal pocket 26 but, if with sufficient magnification of a cross-section of one of the protuberances 22, it can be seen that at least some portion of the hollow internal pocket 26 is devoid of warp filaments, then the protuberance 22 is regarded as being "hollow".

The shape of the hollow interior pocket may be, for example, semi-circular, round, oval, or rectangular. In one preferred embodiment, the hollow interior pocket may be somewhat domed and have non-linear top edges when viewed in the cross-section. Both the width and height of the hollow internal pockets can be varied. Further, the size of the internal pocket may vary within a particular or individual protuberance and it also may vary as between different protuberance. With reference to FIG. 5, generally the width (w) of the hollow interior pocket 26 is measured at the widest point of the pocket between the interior surface 15 of warp filaments 14 forming the inner shell 29 and the upper surface plane of the landing area 13. The height (h) of the hollow interior pocket 26 is measured at the tallest point between the interior surface 15 of warp filaments 14 forming the inner shell 27 and the upper surface 19 of the shute filament 18 forming the bottom of the inner shell 27.

One advantage of providing at least a portion of the protuberances with a hollow interior pocket is that the pocket may facilitate air transfer throughout the internal pocket in the plane of the machine direction and the cross-machine direction, and additionally, through the papermaking fabric on both the machine contacting side and the web contacting side due to the interstitial spacing between the filaments defining the internal pocket. In this manner a fabric may be provided in which both the protuberances and the landing areas are air permeable and more preferably both are permeable to both air and water. Making both the protuberances and the landing areas air permeable increases the overall permeability of the fabric and can provide a distinct advantage over woven papermaking fabrics that include filaments that are stacked to form the protuberances and are not air permeable. Compared to prior art woven fabrics, the instant woven fabrics may have increased air permeability from the web to machine contacting sides of the fabric and the permeability may be more uniform throughout the web contacting surface of the fabric. Further, the improvement in permeability is achieved without a loss in web contacting surface topography. The present fabrics may produce tissue products having improved properties, while also providing enhanced drying and handling characteristics for a tissue web being transported by and/or manufactured on the papermaking fabric.

Additionally, an air permeability of the machine contacting side of the papermaking fabric can be substantially the same as an air permeability of the web contacting side of the papermaking fabric. For purposes herein, the air permeability can be measured by the Frazier Air Permeability test as known in the art. The Frazier Air Permeability test measures the permeability of a fabric as standard cubic feet of air flow per square foot of material per minute with an air pressure differential of 0.5 inches (12.7 mm) of water under standard conditions. For example, throughdrying fabrics can have a permeability from about 55 standard cubic feet per square foot per minute (about 16 standard cubic meters per square meter per minute) or higher, more specifically from about 100 standard cubic feet per square foot per minute (about 30 standard cubic meters per square meter per minute) to about 1,700 standard cubic feet per square foot per minute (about 520 standard cubic meters per square meter per minute), and most specifically from about 200 standard cubic feet per square foot per minute (about 60 standard cubic meters per square meter per minute) to about 1,500 standard cubic feet per square foot per minute (about 460 standard cubic meters per square meter per minute). For purposes herein, two measured air permeabilities can be referred to as being "substantially the same" when one air permeability value is within 5 percent of the comparative air permeability value.

In embodiments where the papermaking fabric is utilized as a transfer fabric, the papermaking fabric can provide improved dewatering of the tissue web before the sheet is delivered to the through-air drying fabric. It is believed that the papermaking fabric can provide improve sheet uniformity and lead to a reduction in pin holes. This can provide benefits in drying at the through-air drying fabric as well as with improved properties (e.g., tensile strength) of the tissue web.

In the embodiments illustrated in FIGS. 1-5, the protuberance 22 is disposed on the web contacting surface 20 and formed from a plurality of warp filaments 14. The protuberances 22 are arranged generally parallel to one another and extend in a continuous fashion along a first major axis 25, which lies at an element angle ($\alpha$) relative to the MD axis 27. The protuberance 22 generally comprises a top surface lying in an upper surface plane 30 (shown in FIG. 5). Generally the portions of the warp yarns forming the protuberances are the highest points on the surface of the fabric and define a second fabric surface plane. The protuberances 22 generally extend in the z-direction (generally orthogonal to both the machine direction and cross-machine direction) above the landing area surface plane 13. It is generally preferred that for a given protuberance the upper surface plane extends uninterrupted for the length of the protuberance.

The cross-section shape of the protuberance may vary depending on the size, shape and number of warp filaments that make-up the protuberance. For example, as illustrated in FIGS. 4 and 5, the plurality of warps 14 are used to form a protuberance 22 having a semi-circular cross sectional shape having an upper surface plane 30 that lies above the landing area surface plane 13 in the z-direction providing the protuberance 22 with a height (H). One skilled in the art will appreciate that the height of the protuberances may be altered by selecting warp filaments of different sizes and shapes and by the number of warps forming a given protuberance. In certain embodiments the protuberance height (H) may be varied depending on the desired degree of molding and the resulting tissue product properties. In certain embodiments the height (H) may be greater than about 0.1 mm, such as from about 0.1 to about 10.00 mm, more preferably from about 0.25 to about 3.0 mm, and in a particularly preferred embodiment between from about 0.5 to about 2.5 mm. In other embodiments all of the protuberances have a substantially equal height (H), such as from about 1.0 to about 2.5 mm, which is generally measured using a profilometer as described herein. While the height of the protuberances is illustrated as being substantially uniform amongst the protuberances, the invention is not so limited and the protuberances may have different heights.

In certain embodiments it may be preferred that for a given protuberance the upper surface plane extends uninterrupted for the length of the protuberance resulting in a protuberance having a height that is generally uniform along its length. For example, where a protuberance is continuous and extends throughout one dimension of the papermaking fabric its upper surface plane is preferably uninterrupted along the entire length to provide a single protuberance a substantially continuous height along its length. While it is generally desirable that the height of a protuberance be substantially constant along its length slight height variances can be expected as a result of the protuberances being formed from woven filaments. For example, it may be desirable that the height of a given protuberance vary less than ±150 μm and more preferably less than about ±100 μm along its length. To ensure that the height of a given protuberance is substantially constant along its length, it may be preferable to weave the protuberances from one or more warp filaments without inspecting or interrupting the one or more warp filaments with shute filaments.

The protuberance width (w) may also vary depending on the construction of the fabric and its intended use. Protuberance width (w) is generally measured normal to the principal dimension of the protuberance in a plane defined by the cross-machine direction (CD) at a given location. Where the protuberance has a generally square or rectangular cross-section, the width is generally measured as the distance between the two planar sidewalls that form the protuberance. In those cases where the protuberance does not have planar sidewalls the width is measured at the point that provides the greatest width for the configuration of the protuberance. For example, the width of a protuberance not having two planar sidewalls may be measured along the base of the protuberance. In some preferred embodiments, the width of the protuberances can be from about 0.20 to about 3.00, or preferably from about 0.50 to about 2.50 mm, or even more preferably from about 0.70 to about 1.50 mm. Of course, it is contemplated that the width can be outside of the preferred range in some embodiments and still be within the scope of this disclosure.

In certain embodiments the protuberances do not have planar sidewalls, but rather have a generally semi-circular cross-sectional shape. In other embodiments however, the protuberance may be woven so as to form a pair of opposed sidewalls and provide the protuberance with a rectilinear cross-section shape. For example, in one embodiment the protuberance may have a square cross-sectional shape, where the width and height are substantially equal and vary from about 0.5 and 3.5 mm, more preferably from about 0.5 to about 1.5 mm, and in a particularly preferred embodiment between from about 0.7 to about 1.0 mm. However, it is to be understood that because the protuberance are formed from woven filaments having generally circular or oval cross-sectional shapes, the cross-sectional shape of the resulting protuberance may not be perfectly rectilinear, but may have some other cross-sectional shape that is approximately rectilinear.

The spacing and arrangement of protuberances may vary depending on the desired tissue product properties and appearance. If the individual protuberances are too high, or the valley area is too small, the resulting sheet may have excessive pinholes and insufficient compression resistance, CD stretch, and CD TEA, and be of poor quality. Further, tensile strength may be degraded if the span between protuberances greatly exceeds the fiber length. Conversely, if the spacing between adjacent protuberances is too small the tissue will not mold into the valleys without rupturing the sheet, causing excessive sheet holes, poor strength, and poor paper quality.

In one embodiment a plurality of protuberances extends continuously throughout one dimension of the fabric and each protuberance in the plurality is spaced apart from the adjacent protuberance. Thus, the protuberances may be spaced apart across the entire cross-machine direction of the fabric or may run diagonally relative to the machine and cross-machine directions. Of course, the directions of the protuberances alignments (machine direction, cross-machine direction, or diagonal) discussed above refer to the principal alignment of the protuberances. Within each alignment, the protuberances may have segments aligned at other directions, but aggregate to yield the particular alignment of the entire protuberance.

Further while the illustrated fabrics, such as those shown in FIG. 3, comprise protuberances 22 having similar size, shape and pitch to provide the fabric 10 with a single uniform pattern, it is contemplated that a papermaking fabric can include a plurality of protuberances that differ in at least one regard to form two or more patterns.

In addition to varying the spacing and arrangement of the protuberances along the fabric, the shape of the protuberance may also be varied. For example, in one embodiment, the protuberances are arranged substantially parallel to one another such that none of the protuberances intersect one another. For example, each of the protuberances may be arranged generally parallel to one another, with no two protuberances crossing one another and each of the protuberances equally spaced apart from one another. Generally, the center-to-center spacing of individual protuberances (also referred to herein as pitch or simply as P) may be greater than about 1.0 mm, such as from about 1.0 to about 20.0 mm apart and more preferably from about 2.0 to about 10.0 mm apart. In one particularly preferred embodiment the protuberances are spaced apart from one-another from about 3.8 to about 4.4 mm. This spacing will result in a tissue web which generates maximum caliper when made of conventional cellulosic fibers. Further, this arrangement provides a tissue web having three dimensional surface topography, yet relatively uniform density.

In a particularly preferred embodiment, such as that illustrated in FIG. 1, the protuberances 22*a*-22*c* have a major axis 25 that is substantially oriented in the machine direction and the protuberances are arranged generally parallel to one another such that none of the protuberances contact or intersect one another. In this manner adjacent protuberances, such as protuberances 22*a* and 22*b*, are spaced apart from one another a uniform distance. The center-to-center spacing between adjacent protuberances can be defined as the pitch (P) of the protuberances. In some embodiments the MD oriented protuberances 22*a*, 22*b* can be configured such that they are substantially aligned in the machine direction (MD) and substantially equally spaced apart from one another such that the pitch (P1) is relatively uniform. Regardless of the direction of the alignment of the protuberances, the pitch (P1) can be greater than about 0.5 mm, such as from about 0.5 to about 10.0 mm apart and more preferably from about 1.0 to about 5.0 mm apart and still more preferably from about 1.5 to about 2.5 mm apart.

Exemplary weave patterns and methods of manufacturing a woven papermaking fabric will now be described. In one embodiment, the papermaking fabric could be manufactured by providing a first set of filaments and a second set of filaments that are woven in a weave pattern where the first set of filaments has a different shrinkage property than the second set of filaments. Upon heat finishing the woven papermaking fabric, the difference in shrinkage properties between the first set of filaments and the second set of filaments causes buckling of the woven papermaking fabric to provide protuberances with hollow internal pockets, as discussed above.

Figure 6A:
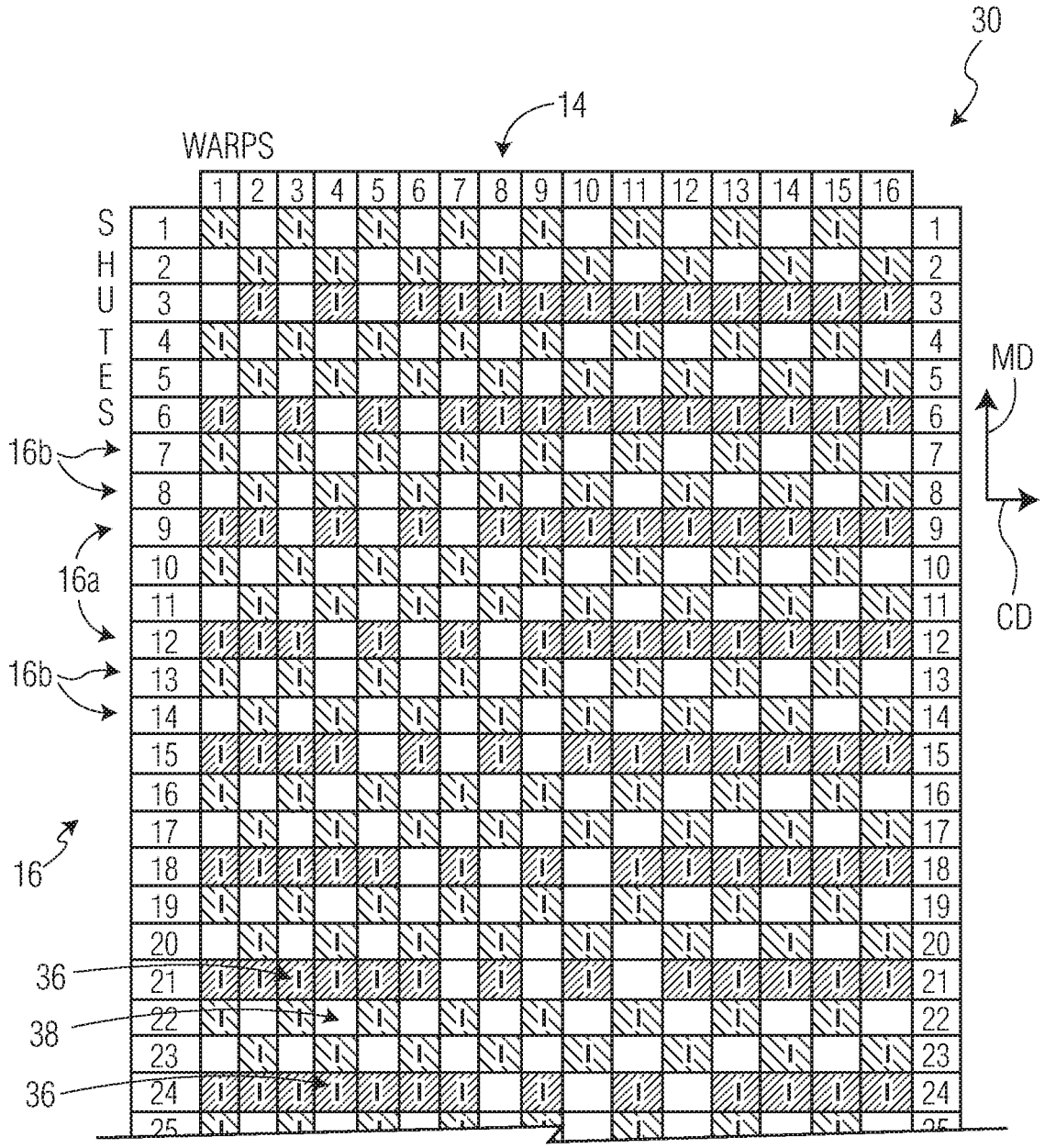
FIGS. 6A and 6B illustrate a unit cell of one exemplary weave pattern to produce a papermaking fabric of the present disclosure.
Figure 6B:
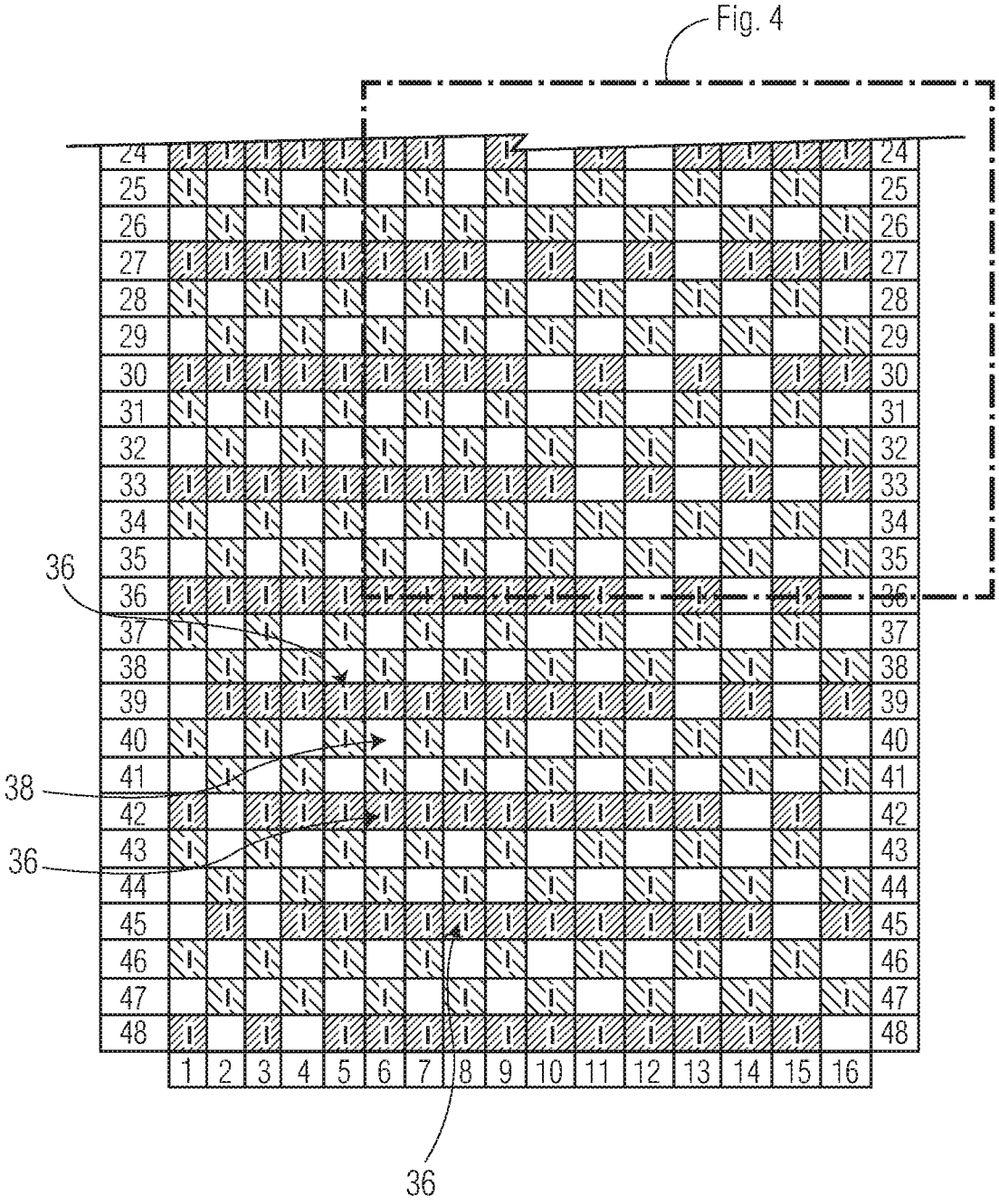

FIGS. 6A and 6B demonstrate a unit cell of an exemplary weave pattern 30 for a papermaking fabric 10 having filaments that have different shrinkage properties that can provide the papermaking fabric 10 as depicted in FIGS. 1 and 2 and as described above. The weave pattern 30 forming the unit cell is provided on two separate sheets in two figures for purposes of clarity, but is one continuous unit cell. The weave pattern 30 as provided in the unit cell of FIGS. 6A and 6B can be repeated as many times as desired in the machine direction and/or the cross-machine direction to form a twill pattern of protuberances 22 in the papermaking fabric 10. As depicted in FIGS. 6A and 6B, unit cells for the weave pattern 30 can have a plurality of warp filaments 14 (sixteen in FIGS. 6A and 6B), generally aligned in the machine direction. There can also be a plurality of shute filaments 16, generally aligned in the cross-machine direction. The weaving can be conducted on a loom according to the weave pattern 30, as is known by those of ordinary skill in the art. Each interchange of a specific warp filament 14 and a specific shute filament 16 of the weave pattern 30 that includes a vertical line segment (or a capital letter "I") provides a notation that the specific warp filament 14 is woven above the specific shute filament 16 at that interchange. For example, the interchange of warp filament No. 1 and shute filament No. 1 includes such a vertical line segment in FIG. 6A, and thus, warp filament No. 1 is woven above shute filament No. 1.

In the weave pattern 30 depicted in the unit cell of FIGS. 6A and 6B, the shute filaments 16 can be comprised of filaments having two different shrinkage properties. This is depicted by different cross-hatching in specific interchanges of warp filaments 14 and shute filaments 16. For example, every third shute filament (e.g., shute filaments nos. 3, 6, 9, 12, etc.) can be a filament having a first shrinkage property, and can be referred to as the first shute filaments 16*a* (only two first shute filaments 16*a* being labeled in FIG. 6A for clarity). These shute filaments 16*a* have a dense cross-hatching pattern at the interchanges where the warp filaments 14 are woven above the shute filaments 16*a*. Additionally, the shute filaments 16 can also include other filaments (e.g., shute filaments nos. 1, 2, 4, 5, 7, 8, 10, 11, etc.) that can have a second shrinkage property, and can be referred to as the second shute filaments 16*b* (only four second shute filaments 16*b* being labeled in FIG. 6A for purposes of clarity). The first shrinkage property of the first shute filaments 16*a* can be different than the second shrinkage property of the second shute filaments 16*b*. The shrinkage property being considered as the first shrinkage property and the second shrinkage property can be the property of free shrink. In the weave pattern 30 depicted in FIGS. 6A and 6B, it is preferable to have the first shrinkage property for the first shute filaments 16*a* forming every third shute filament have a higher free shrink than the filaments forming the second shute filaments 16*b* (e.g., shute filaments nos. 1, 2, 4, 5, 7, 8, 10, 11, etc.). In one embodiment, the first shrinkage property can have a free shrink of 15 percent or more and the second shrinkage property can have a free shrink of 7 percent or less. In one example, the first shrinkage property can have a free shrink of about 20 percent or about 22 percent or greater, and the second shrinkage property can have a free shrink of about 5 percent or about 1 percent or less. The shrinkage property being considered as the first shrinkage property and the second shrinkage property can alternatively be the property of shrink force.

The difference in shrinkage properties between filaments 12 of the weave pattern 30 discussed above can be provided in different ways. For example, the first shute filaments 16*a* having a first shrinkage property and the second shute filaments 16*b* having a second shrinkage property can be provided such that the first shute filaments 16*a* could be comprised of a different material than the second shute filaments 16*b* that have different shrinkage characteristics from one another. Alternatively and/or additionally, the first shute filaments 16*a* and the second shute filaments 16*b* could comprise the same material, such as polyethylene teraphthalate (PET), but the first shute filaments 16*a* could be processed in a different manner than the second shute filaments 16*b* such that the first shute filaments 16*a* have a different shrinkage property than the second shute filaments 16*b*. As but one example, the first shute filaments 16*a* could be DFP 347 (PET) and the second shute filaments 16*b* could be DFP 533 (PET), with the DFP 347 filaments having a higher free shrink than the DFP 533 filaments.

In one embodiment, the warp filaments 14 can have the same or a similar shrinkage property to the second shute filaments 16*b* having the second shrinkage property. In some embodiments, the warp filaments 14 can comprise a third shrinkage property that can be different than the first shrinkage property and/or the second shrinkage property. It is also conceived that the shute filaments 16 could include various other filaments that have different shrinkage properties than the first shrinkage property of the first shute filaments 16*a* and the second shrinkage property of the second shute filaments 16*b*. Similarly, it is also conceived that the warp filaments 14 could include filaments that have more than two different shrinkage properties. One exemplary warp filament 14 that can be preferred for a papermaking fabric 10 used as a transfer fabric can include FFP 875 (PET). One exemplary warp filament 14 that can be preferred for a papermaking fabric 10 used as a through-air drying fabric can be FFA 915 (Polyphenylene sulphide or PPS).

The weave pattern 30 of FIGS. 6A and 6B include CD oriented floats 36 in the first shute filaments 16*a* having the higher shrinkage property (shute filaments 3, 6, 9, 12, etc.) on the top side of the weave pattern 30. As used herein, a "float" means a portion of a weave pattern in which a group of successive interchanges between warp filaments 14 and shute filaments 16 are woven such that the warp filaments 14 are above the shute filaments 16. The floats 36 can be oriented in various directions, shapes, and be of various lengths and/or widths. For example, one CD oriented float 36 is shown in shute filament no. 39 in FIG. 6B, in which warp filaments Nos. 2-12 are woven above the shute filament No. 39. Other CD oriented floats 36 can be seen in the first shute filaments 16*a* having the higher shrinkage property (shute filaments 3, 6, 9, 12, etc.), with the adjacent floats 36 starting and stopping at different warp filaments 14 positions to provide a diagonal twill pattern with CD oriented floats 36 on every third shute filament 16. For purposes of clarity, however, only two cross-machine direction oriented floats 36 are labeled in each of FIG. 6A and FIG. 6B. Of course, it is contemplated that the spacing of the first shute filaments 16*a* having the higher shrinkage property could be varied from every third shute filament 16 in different embodiments. It is also contemplated that the direction, orientation, length, and width of the floats 36 can be modified from the exemplary weave pattern 30 shown in FIGS. 6A and 6B.

The weave pattern 30 of FIGS. 6A and 6B can also include a high friction tying area 38 in the lateral area between the CD floats 36. Detailed view FIG. 4 displays a portion of the weave pattern 30 from FIG. 6B, displaying shute filaments Nos. 24-35 and warp filaments Nos. 6-16. As shown in the detailed view of FIG. 4, the lateral area between CD floats 36 is a weaving pattern that provides high friction and that can be described in a lateral direction (cross-machine direction) as a "one-by-one" pattern in that a specific shute filament 16 is woven below a warp filament 14, then above the adjacent warp filament 14 and repeated in that fashion. For example, looking at the shute filament No. 30 between the two cross-direction floats 36 provides an example of the "one-by-one" pattern. In a longitudinal direction (machine direction), the high friction tying area 38 provides a "two-one-one-two" weaving pattern in that a specific warp filament 14 is above two shute filaments 16, below the next adjacent shute filament 16, above the next adjacent shute filament 16, and then below the next two adjacent shute filaments 16, and then repeated in that fashion. For example, referring to warp filament No. 12 in FIG. 7 starting at the interchange with shute filament 26 and working in a downward direction, warp filament No. 12 is woven above shute filaments Nos. 26 and 27, woven below shute filament No. 28, woven above shute filament No. 29, and woven below shute filaments Nos. 30 and 31. The high friction tying areas 38 between CD oriented floats 36 ultimately correspond to the land areas 24 of the papermaking fabric 10 as discussed above and as illustrated in FIGS. 1 and 2. Of course, it is contemplated that the weave pattern 30 in the high friction tying areas 38 can be modified from the exemplary pattern as shown in FIGS. 6A and 6B, yet still be within the scope of this disclosure. It is contemplated that the size of the area forming the high friction tying area 38 can also change based on the desired area of the land area 24 between protuberances 22.

After the weave pattern 30 of FIGS. 6A and 6B is completed, the woven fabric can be heat finished. Suitable heat finishing techniques are known by those of ordinary skill in the art. After heat finishing, the first shute filaments 16*a* having the first shrinkage property can shrink more than the second shute filaments 16*b* having the second shrinkage property, causing a buckling of the woven fabric and the long CD oriented floats 36 to provide protuberances 22 with internal pockets 26 on the web contacting side 20 of the woven fabric. The combination of the longitudinal spacing of the CD floats 36 in the first shute filaments 16*a*, the first shute filaments 16*a* having a higher shrinkage property than the second shute filaments 16*b*, and the high friction tying areas 38 between the CD floats 36 allow the first shute filaments 16*a* to shrink and cause the adjacent second shute filaments 16*b* in the longitudinal areas between CD floats 36 to buckle and form the protuberances 22 on the web contacting side 20 of the papermaking fabric 10 after heat finishing. The first shute filaments 16*a* form the machine contacting side 18 of the papermaking fabric 10 below the protuberances 22, and thus, the spacing of the first shute filaments 16*a* being separated by the second shute filaments 16*b* and being woven together with the warp filaments 14 provides the internal pockets 26 in the protuberances 22. The high friction tying areas 38 between the CD floats 36 provide stability to the weave pattern 30 to create the protuberances 22 and the land areas 24 between protuberances 22.

Figure 7:
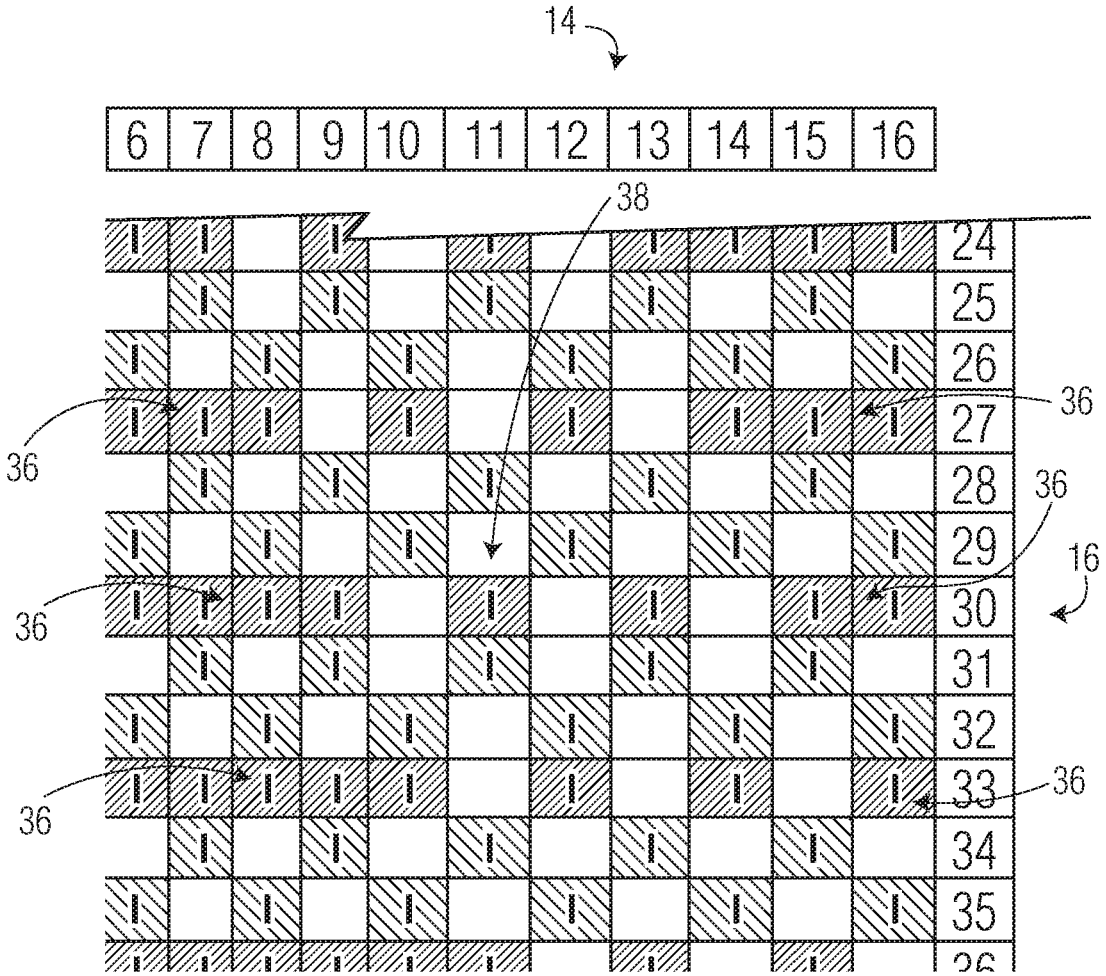
FIG. 7 illustrates a detailed view of a portion of the weave pattern of FIGS. 6A and 6B.
Figure 8:
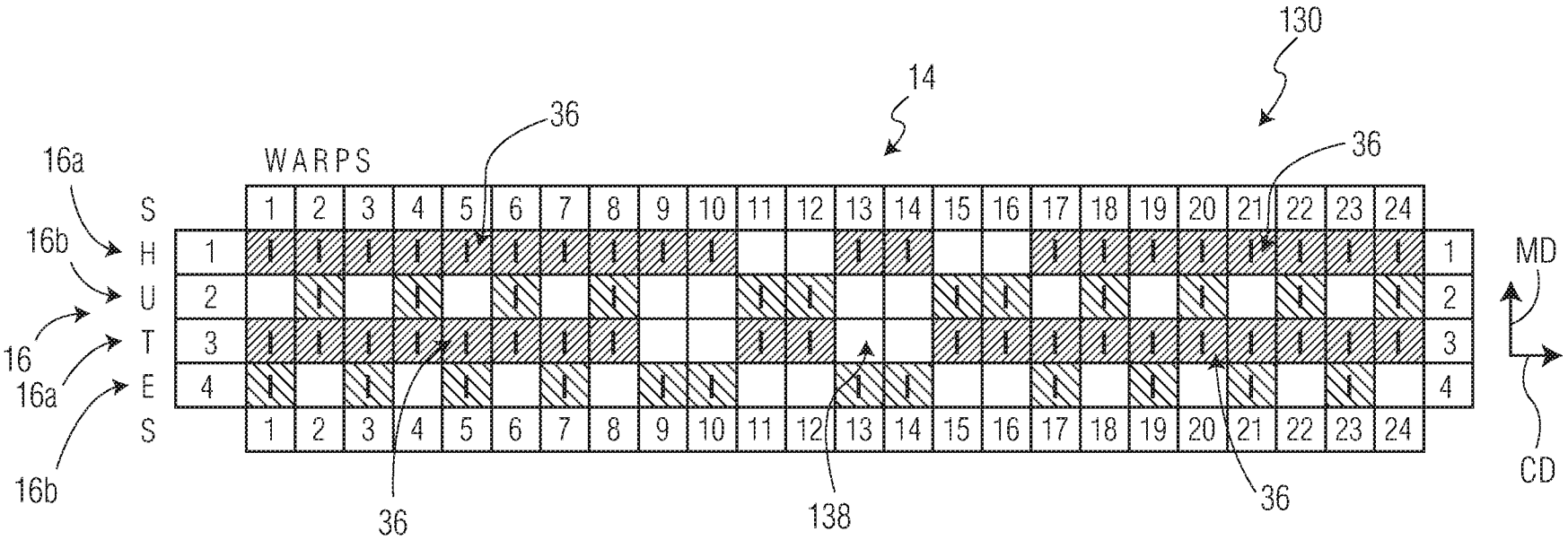
FIG. 8 illustrates a unit cell of another exemplary weave pattern to produce a papermaking fabric of the present disclosure.

FIG. 8 illustrates an alternative embodiment of a unit cell for a weave pattern 130 for a papermaking fabric 10 of this disclosure that can include machine direction oriented protuberances 22 that includes internal pockets 26 as described above. The weave pattern 130 includes first shute filaments 16*a* having a first shrinkage property and second shute filaments 16*b* having a second shrinkage property. The first shrinkage property of the first shute filaments 16*a* can be greater than the second shrinkage property of the second shute filaments 16*b*, similar to the discussion above with respect to weave pattern 30 depicted in FIGS. 6A and 6B and shown in similar cross-hatching at interchanges where the warp filament is above a specific shute filament. The first shute filaments 16*a* can be spaced above every other shute filament 16 (e.g., shute filament Nos. 1 and 3) with the second shute filaments 16*b*. The weave pattern 130 in the unit cell depicted in FIG. 7 can also include CD oriented floats 36 in the first shute filaments 16*a* having the higher shrinkage property. The weave pattern 130 also includes a high friction tying area 138 between the cross-direction oriented floats 36, but woven in a different pattern to the high friction tying area 38 described above with respect to weave pattern 30 in FIGS. 6A and 6B. However, the high friction tying area 138 in the weave pattern 130 depicted in FIG. 7 provides similar stability to the weave pattern 130 to create the protuberances 22 and land areas 24.

It is to be understood that other weave patterns can also be utilized by one of ordinary skill in the art to provide a papermaking fabric 10 with at least one protuberance 22 with a hollow internal pocket 26. The use of at least two sets of filaments having different shrinkage properties, but variances in the weave pattern 30 from that as described above, can provide different patterns of protuberances 22 with internal pockets 26 to provide different decorative patterns as desired. For example, while the weave patterns 30, 130 provide protuberances 22 oriented in a twill pattern and in a machine-direction oriented pattern, respectively, it is contemplated that alternative weave patterns could be constructed to provide CD oriented protuberances 22 including internal pockets 26. For instance, a weave pattern could include warp filaments 14 having different sets of filaments with different shrinkage properties from one another (such as a set of DFP 347 filaments and a set of DFP 533 filaments), such that the shrinkage and buckling occurs in the machine direction to form CD oriented protuberances 22 having internal pockets 26. It is to be appreciated that other weave patterns could provide a plurality of protuberances 22 with internal pockets 26 in which some of the protuberances 22 extend in the machine direction and some of the protuberances 22 extend in the cross-machine direction. It is also contemplated that weave patterns could be modified to provide protuberances 22 that form various other decorative patterns on a papermaking fabric 10.

Additionally, the papermaking fabric 10 can include additional components as is known in the art, such as sacrificial wear elements (not shown). The sacrificial wear elements can be disposed on the machine contacting side 18 of the papermaking fabric 10 and can be of a variety of shapes and sizes, such as rounded, rectangular, sinusoidal, etc. The sacrificial wear elements can extend the effective life of the papermaking fabric 10.

TEST METHOD

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three dimension height map of the sample surface. A 1602×1602 array of height values were obtained with a 30 μιη spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

EMBODIMENTS

Embodiment 1

A woven papermaking fabric having a machine direction (MD) axis and cross-machine direction (CD) axis, a machine contacting side and a web contacting side, the fabric comprising a plurality of substantially MD oriented warp filaments, and a plurality of substantially CD oriented shute filaments, the shute filaments being interwoven with warp filaments to provide at least one protuberance on the web contacting side of the fabric, the at least one protuberance having a hollow internal pocket.

Embodiment 2

The papermaking fabric of embodiment 1, wherein the at least one protuberance is air permeable.

Embodiment 3

The papermaking fabric of embodiments 1 or 2, wherein the plurality of filaments comprise: a first set of filaments having a first shrinkage property; and a second set of filaments having a second shrinkage property, the first shrinkage property being different from the second shrinkage property, wherein the difference between the first shrinkage property and the second shrinkage property creates the at least one protuberance upon heat finishing of the first set of filaments and the second set of filaments.

Embodiment 4

The papermaking fabric of embodiment 3, wherein the first set of filaments and the second set of filaments are shute filaments.

Embodiment 5

The papermaking fabric of embodiment 3 or embodiment 4, wherein the difference between the first shrinkage property and the second shrinkage property is provided by the first set of filaments comprising a first material and the second set of filaments comprising a second material, the first material being different from the second material.

Embodiment 6

The papermaking fabric of embodiment 3 or embodiment 4, wherein the difference between the first shrinkage property and the second shrinkage property is provided by the first set of filaments comprising a first processing parameter and the second set of filaments comprising a second processing parameter, the first processing parameter being different from the second processing parameter.

Embodiment 7

The papermaking fabric of any of the preceding embodiments, further comprising a plurality of protuberances on the web contacting side of the papermaking fabric, the plurality of protuberances providing a plurality of internal pockets, and the plurality of protuberances being air permeable.

Embodiment 8

The papermaking fabric of embodiment 7, wherein the plurality of protuberances are continuous.

Embodiment 9

The papermaking fabric of embodiment 7, wherein the plurality of protuberances are discontinuous.

Embodiment 10

A papermaking fabric including a machine contacting side and a web contacting side, the papermaking fabric comprising: a first set of filaments including a first shrinkage property; and a second set of filaments including a second shrinkage property, the first shrinkage property being different from the second shrinkage property; the first set of filaments and the second set of filaments being woven and providing at least one protuberance on the web contacting side of the papermaking fabric, the at least one protuberance defining a hollow internal pocket.

Embodiment 11

The papermaking fabric of embodiment 10, wherein the at least one protuberance is air permeable.

Embodiment 12

The papermaking fabric of embodiment 10 or 11, wherein the internal pocket is continuous for the length of the papermaking fabric.

Embodiment 13

The papermaking fabric of embodiment 10, further comprising a plurality of protuberances on the web contacting side including a hollow internal pocket, the plurality of protuberances being air permeable.

Embodiment 14

The papermaking fabric of any one of embodiments 10 through 13, wherein the difference between the first shrinkage property and the second shrinkage property is provided by the first set of filaments comprising a first material and the second set of filaments comprising a second material, the first material being different from the second material.

Embodiment 15

The papermaking fabric of any one of embodiments 10 through 13, wherein the difference between the first shrinkage property and the second shrinkage property is provided by the first set of filaments comprising a first processing parameter and the second set of filaments comprising a second processing parameter, the first processing parameter being different from the second processing parameter.

Embodiment 16

A method of manufacturing a papermaking fabric, the method comprising: providing a plurality of warp filaments and a plurality of shute filaments for weaving, at least one of the plurality of warp filaments and the plurality of shute filaments comprising: a first set of filaments including a first shrinkage property; and a second set of filaments including a second shrinkage property, the first shrinkage property being different than the second shrinkage property; weaving the shute filaments and the warp filaments in a weave pattern to provide a woven fabric including a first machine direction end opposite from a second machine direction end and a machine contacting side opposite from a web contacting side; heat finishing the first set of filaments and the second set of filaments after the plurality of shute filaments and the plurality of warp filaments are woven, the weave pattern and the heat finishing providing at least one protuberance including a hollow internal pocket, the internal pocket including a height and a width; and connecting the first machine direction end of the woven fabric to the second machine direction end of the woven fabric to provide a seam for the papermaking fabric.

Embodiment 17

The method of embodiment 16, wherein the protuberance is air permeable.

Embodiment 18

The method of embodiment 16 or 17, wherein the weave pattern comprises a plurality of floats and at least one high friction tying area, wherein each of the floats of the plurality of floats are spaced apart from one another, and the high friction tying area is located between spaced floats.

Embodiment 19

The method of any one of embodiments 16 through 18, wherein the first set of filaments and the second set of filaments each serve as shute filaments in the loom.

Embodiment 20

The method of any one of embodiments 16 through 19, wherein the weave pattern and the heat finishing provide a plurality of protuberances including a hollow internal pocket, the plurality of protuberances being air permeable.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present disclosure should be assessed as that of the appended claims and any equivalents thereto.

What is claimed is:

1. A woven papermaking fabric having a machine direction (MD) axis and cross-machine direction (CD) axis, a machine contacting side and a web contacting side, the fabric comprising a plurality of substantially MD oriented warp filaments having a first shrinkage property, and a plurality of substantially CD oriented shute filaments having a second shrinkage property different than the first shrinkage property, the shute filaments being interwoven with warp filaments to provide at least one protuberance formed by heat finishing of the warp and shute filaments on the web contacting side of the fabric, the at least one protuberance having a hollow internal pocket, a length, a height and an element angle, wherein the height is substantially constant along the length and the element angle is greater than about 0.5 degrees.

2. The woven papermaking fabric of claim 1 wherein the at least one protuberance has an element angle from 5.0 to 10.0 degrees.

3. The woven papermaking fabric of claim 1 wherein the at least one protuberance comprises from 2 to 6 warp filaments.

4. The woven papermaking fabric of claim 1 wherein the at least one protuberance is air permeable.

5. The woven papermaking fabric of claim 1 wherein the air permeability of the web contacting side of the fabric is substantially the same as the air permeability of the machine contacting side of the fabric.

6. The woven papermaking fabric of claim 1 wherein the difference between the first shrinkage property and the second shrinkage property is provided by the warp filaments comprising a first material and the shute filaments comprising a second material, the first material being different from the second material.

7. The woven papermaking fabric of claim 1 wherein the difference between the first shrinkage property and the second shrinkage property is provided by warp filaments comprising a first processing parameter and the shute filaments comprising a second processing parameter, the first processing parameter being different from the second processing parameter.

8. A method of manufacturing a papermaking fabric, the method comprising:

a. providing a plurality of warp filaments and a plurality of shute filaments for weaving, at least a portion of the plurality of warp filaments having a first shrinkage property and a portion of the plurality of shute filaments having a second shrinkage property, the first shrinkage property being different than the second shrinkage property;

b. weaving the shute filaments and the warp filaments in a weave pattern to provide a woven fabric including a first machine direction end opposite from a second machine direction end and a machine contacting side opposite from a web contacting side;

c. heating the shute filaments and the warp filaments after the plurality of shute filaments and the plurality of warp filaments are woven, wherein heating results in a plurality of protuberances having a hollow internal pocket, the plurality of protuberances spaced apart from one another to define landing areas therebetween, the landing areas being from two to ten warps wide; and d. seaming together the first and second machine direction ends of the woven fabric.

9. The method of claim 8 wherein the first shrinkage property is a free shrink of at least about 20 percent and the second shrinkage property is a free shrink less than about 5 percent.

10. The method of claim 8 wherein the weave pattern comprises a plurality of floats and at least one high friction tying area, wherein each of the floats of the plurality of floats are spaced apart from one another, and the high friction tying area is located between spaced floats.

11. The method of claim 8 wherein the plurality of protuberances and the landing areas are air permeable.

* * * * *